US011635732B2

(12) United States Patent
Vuillemez et al.

(10) Patent No.: US 11,635,732 B2
(45) Date of Patent: Apr. 25, 2023

(54) CORRECTION DEVICE FOR A TIMEPIECE

(71) Applicant: RICHEMONT INTERNATIONAL SA, Villars-sur-Glâne (CH)

(72) Inventors: Samuel Vuillemez, Beringen (CH); Séverin Donze, Les Breuleux (CH)

(73) Assignee: RICHEMONT INTERNATIONAL SA, Villars-sur-Glâne (CH)

( * ) Notice: Subject to any disclaimer, the term of this patent is extended or adjusted under 35 U.S.C. 154(b) by 611 days.

(21) Appl. No.: 16/755,285

(22) PCT Filed: Oct. 15, 2018

(86) PCT No.: PCT/EP2018/078100
§ 371 (c)(1),
(2) Date: Apr. 10, 2020

(87) PCT Pub. No.: WO2019/081253
PCT Pub. Date: May 2, 2019

(65) Prior Publication Data

US 2020/0249628 A1 Aug. 6, 2020

(30) Foreign Application Priority Data

Oct. 24, 2017 (CH) ..... 01294/17

(51) Int. Cl.
*G04B 19/25* (2006.01)
*G04B 27/00* (2006.01)

(52) U.S. Cl.
CPC ..... *G04B 19/25* (2013.01); *G04B 27/001* (2013.01)

(58) Field of Classification Search
CPC ..... G04B 19/24; G04B 19/25; G04B 27/00; G04B 27/001
See application file for complete search history.

(56) References Cited

U.S. PATENT DOCUMENTS 3,710,567 A 1/1973 Cleusix
4,443,112 A 4/1984 Stotz et al.
(Continued)

*Primary Examiner* — Edwin A. Leon
*Assistant Examiner* — Jason M Collins
(74) *Attorney, Agent, or Firm* — Duane Morris LLP; Gregory M. Lefkowitz

(57) ABSTRACT

A correction device for a timepiece, including a differential gear having a first input, a second input and an outlet output, wherein: — the first inlct input is arranged to be driven by a timepiece movement; — the second input is kinematically linked with a corrector gear extending from a control member and including a clutch for establishing and interrupting the kinematic link between the control member and the second input; — the output is arranged to drive a display device of the timepiece movement, the angular position of the output being defined on the basis of the angular position of the first input as well as on that of the second input, wherein the correction device further includes a memory cam desmodromically linked with the second input, in that the memory cam experiences a return force provided by a resilient member tending to maintain the memory cam in at least one predetermined angular position when the kinematic link between the control member and the second input is interrupted, the resilient member also being arranged to allow a rotation of the second input under the control of the control member when the kinematic link is established during the use of the correction device, and in that the correction device is arranged so that the incidence of the rotation of the second input during a correction on the angular position of the output is removed when the memory cam is located in the at least one predetermined angular position.

11 Claims, 2 Drawing Sheets

(56) References Cited

U.S. PATENT DOCUMENTS

| | | | | |
|---|---|---|---|---|
| 2013/0176827 | A1 | 7/2013 | Zaugg | |
| 2014/0321247 | A1 * | 10/2014 | Cattaneo | G04B 27/023 368/27 |

* cited by examiner

CORRECTION DEVICE FOR A TIMEPIECE

CROSS-REFERENCE TO RELATED APPLICATIONS

This application is a § 371 national stage entry of International Application No. PCT/EP2018/078100, filed Oct. 15, 2018, which claims priority of Swiss National Application No. 01294/17, filed Oct. 24, 2017, the entire contents of which are incorporated herein by reference.

TECHNICAL FIELD

The present invention relates to the field of horology. It relates more particularly to a correction device for a timepiece.

STATE OF THE ART

In timepieces that comprise not only a current time display but also a device for displaying other information such as the date, the day of the week, the month, the year or the like, a correction device is necessary to allow the user to set the information displayed by this device. This setting can be performed by means of the setting stem, by means of a dedicated stem, by means of other dedicated means such as one or more push-buttons or the like. Some of these correction devices can exert a damaging influence on the movement, by applying, for example, a torque which can damage the movement if the manual correction is performed around midnight, when actuations of the display devices occur.

For this reason, the document FR 2541005 proposes linking the movement to a calendar display device by means of a differential gear which forms part of the correction device. The first input of this differential is driven by the movement, the second input is driven by an external control member, such as a setting stem, and the output in turn drives the calendar display. By virtue of the interposition of the differential, no damaging torque can be exerted on an element of the movement during a correction, and this correction can be made in both directions if the display device is arranged in an appropriate manner.

In some complex display devices, such as perpetual calendars, the presence of several displays whose information is linked (for example the date, the month, the year, the phase of the moon, etc.), the synchronization of the display of each of these items of information is critical for the device to correctly display the information and also for the indications to advance at the right moment.

When the movement has been stopped for a certain time, it is often necessary to perform a correction of several of these items of information, and thus re-establish the synchronization thereof.

One solution often applied is that of providing correction means dedicated to each of the sub-displays (date, month, day, month, year, phase of the moon) which are associated with push-buttons or with correctors. Each push-button thus acts on a corresponding sub-display, which demands several operations to correct the mechanism. However, these correctors act typically in a single direction, therefore, to obtain a correction of one step in the other direction, it is necessary to pass through the rest of the cycle in the direction of the correction, which can, depending on the construction of the display device, also mal-adjust a downstream sub-display. In such a case, the latter must also be corrected in turn.

The document EP 0191921 describes a solution to this problem by proposing a perpetual calendar in which the correction of the calendar data is performed by means of the setting stem. It is thus impossible to desynchronize the various items of information. However, the kinematics of the movement only allow a correction in a single direction.

The aim of the invention is consequently to propose a timepiece in which the abovementioned deficiencies are at least partially overcome.

DISCLOSURE OF THE INVENTION

More specifically, the invention relates to a correction device for a timepiece, which comprises a differential gear having a first input, a second input and an output.

The first input of said differential is arranged to be driven by a timepiece movement, for example by being driven directly by the movement, at a rate of one revolution in 12 hours.

The second input is kinematically linked with a corrector gear-train extending from a control member and comprising a clutch that permits the establishment and the interruption of the kinematic link between said control member and said second input.

The output is arranged to drive a display device of the timepiece movement, and the angular position of the output is defined as a function of the angular position of said first input and of that of said second input, each of the inputs thus providing a contribution to the angular position of the output.

According to the invention, said correction device further comprises a memory cam desmodromically linked with the second input. This memory cam is subjected to a return force supplied by an elastic member, such as a spring, tending to keep the memory cam in at least one predetermined angular position when the kinematic link between the control member and the second input is broken, that is to say when no correction is being made. When the kinematic link is established during a correction, the elastic member allows a rotation of the second input under the control of the control member, which makes it possible to make a correction of the associated display device.

Finally, the correction device is arranged, notably with respect to the gear ratios concerned, to ensure that the incidence of the rotation of the second input during a correction on the angular position of the output is cancelled when the memory cam is in said at least one predetermined angular position. In other words, the predetermined angular position of the memory cam returns the second input to a "neutral" position when the kinematic link between the control member and the second input is broken.

During a correction, the angular position of the second input contributes to defining, in any manner, the angular position of the output, by being added to or deducted from the angular position defined by the first input. In such a case, the output is mal-adjusted and desynchronized relative to the first input. Since the memory cam is desmodromically linked with the second input, it is arranged to "memorize" the angular deviation corresponding to this offset. When the kinematic link with the control member is declutched at the end of the correction, the action of the return force on the memory cam drives the second input in such a way that this deviation is cancelled. The contribution of the second input to the angular position of the output is thus nullified by setting said input in a corresponding angular position and the synchronization between the output and the first input is restored. Consequently, the driving of the display device by the output is performed at the desired moment, during normal operation.

Other advantageous features are mentioned in the dependent claims.

BRIEF DESCRIPTION OF THE DRAWINGS

Other details of the invention will become more clearly apparent on reading the following description, in reference to the attached drawings in which.

EMBODIMENT OF THE INVENTION

Figure 1:
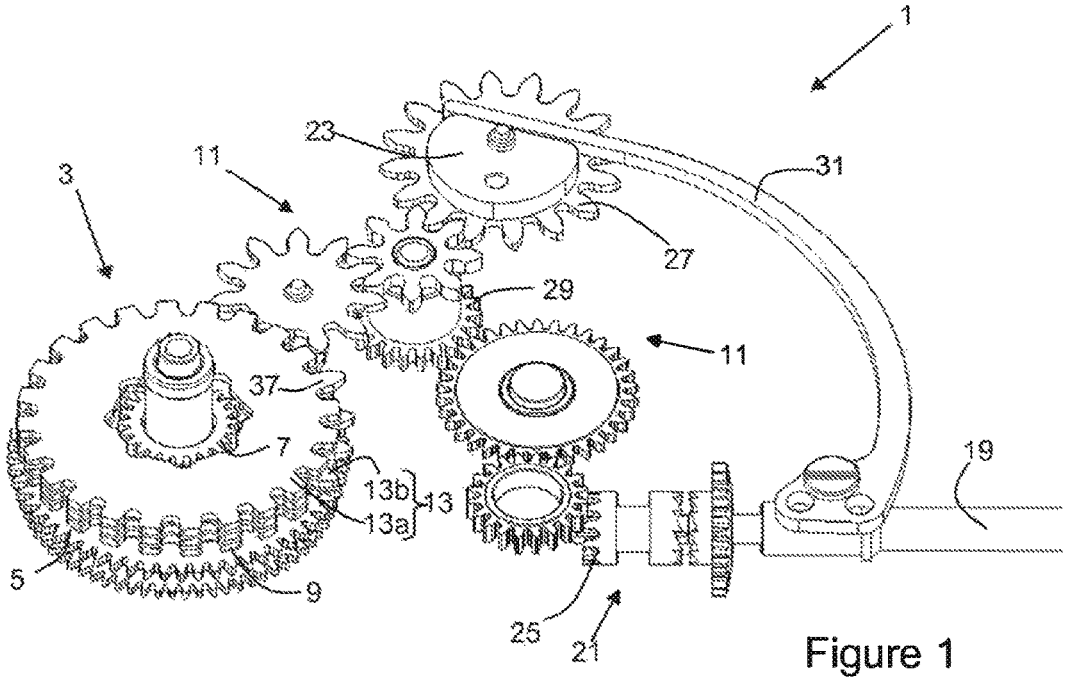
FIG. 1 is an isometric view of a correction device according to the invention.

FIG. 1 illustrates an embodiment of a correction device 1 according to the invention, given as a nonlimiting example. This correction device 1 is intended to correct the information displayed by any particular display device, such as an annual calendar mechanism, but can also be applied to a simple, perpetual or similar calendar. This correction can advantageously be carried out in both directions.

Figure 4:
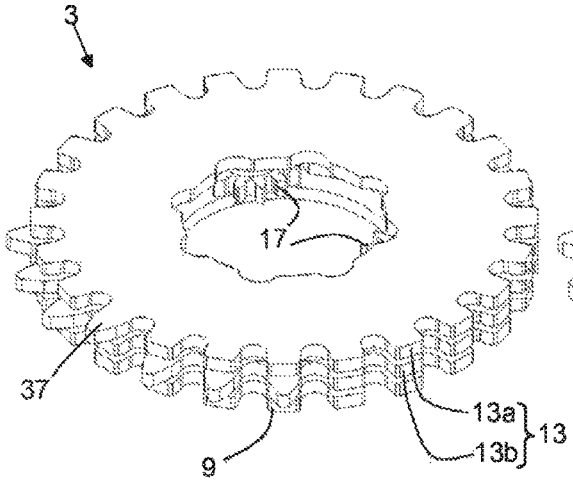
FIG. 4 is an isometric view of a part of the differential gear illustrated in FIGS. 1 to 3.
Figure 5:
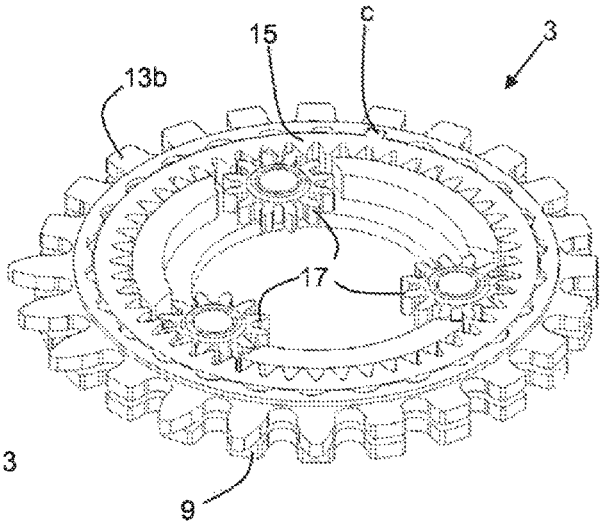
FIG. 5 is a view similar to that of FIG. 4, one of the toothed plates having been removed.

The device 1 comprises a differential gear 3, some details of which are more visible in FIGS. 4 and 5. The differential gear 3 has a first input 5 intended to be driven by a timepiece movement. As in the example, the device can be disposed on a module intended to be driven by a base movement (not illustrated), but application to an integrated construction is also possible.

The movement is intended to drive the first input 5 at an ad-hoc angular speed (typically one revolution in 12 hours), and takes the form of a toothed wheel secured in rotation to a sun pinion 7 situated at the geometrical center of the differential 3. The first input 5 can be driven by any kind of drive system, such as, for example, by being meshed with the hours wheel of the movement. In the present case, the first input is secured in rotation to the hours wheel of the movement and is driven at a rate of one revolution in 12 hours. However, other drive speeds are possible.

The differential 3 further comprises a second input 9, which is a satellite-holder provided with external teeth and on which a plurality of satellite pinions 17 are pivoted. These latter mesh with the sun pinion 7. The external teeth of this satellite-holder mesh with a correction gear-train 11 which is declutchably kinematically linked with a correction member 19 in the form of a correction stem 19. This stem 19 can also serve as a winding stem.

Alternatively, the correction member can take other forms, such as a rotating bezel or a rotating case-back. The person skilled in the art could even arrange two rapid correction push-buttons, one to advance and the other to retire the satellite-holder, while coordinating the clutching and the declutching of the correction chain.

The output 13 of the differential gear comprises two toothed plates 13*a*, 13*b* each having 24 teeth and superposed relative to one another and mutually secured in rotation, for example by means of a key-keyway system c. These plates 13*a*, 13*b* are secured in rotation to a ring gear 15 provided with internal teeth which mesh with the satellite pinions 17. The number of plates and of satellite pinions and their disposition in an epicycloidal train system in the plane ("flat" planetary differential) or in space ("spherical" planetary differential) can be chosen according to the needs of the constructor. Obviously, other differential gear constructions are accessible to the person skilled in the art, and that described here is in no way limiting.

By virtue of this construction, during the normal operation of the display device, that is to say when the movement operates and there is no correction made, the correction gear-train 11 and therefore the second input 9 remain blocked at rest as described below. The output 13 is therefore driven exclusively as a function of the rotation of the first input 5, by means of the sun pinion 7 and the satellites 17. The direction of rotation of the output 13 is thus the reverse of that of the first input 5, and it is subjected to an angular speed reduction, due to the gear ratio of the differential. In this particular case, the first input 5 performs one rotation in 12 hours and its gear ratio with the output 13 is 0.5. Consequently, the latter performs one revolution in 24 hours, as is appropriate for driving a calendar device. To this end, the upper plate 13*a* bears a drive tooth 37 which is longer than the other teeth of said plate. The lower plate 13*b* also bears longer drive teeth as is generally known in the context of the driving of annual or perpetual calendar devices, to perform the end-of-month actuations for months of fewer than 31 days and/or to actuate another display device. Other rotation speeds are of course possible according to the construction of the display device and of the differential gear 3.

During a correction, the first input 5 remains (quasi-) immobile, under the action of the movement and of the escapement, and the second input 9 pivots following a rotation of the correction stem 19 which is transmitted by means of the correction gear-train 11. The rotation of the second input 9 is transmitted consequently to the output 13 by the rotation of the satellites 17 around the center of the differential, and by the rolling of the latter on the sun pinion 7 which remains (quasi-)immobile. The directions of rotation of the second input 9 and of the output 13 are thus the same, but the speed of rotation of the output is less than that of the second input, by virtue of a 2/3 ratio in the embodiment illustrated.

That being the case, and as mentioned in the preamble, the correction gear-train does not exert any influence on the base movement during a correction, and the rotation of the output 13 is a function of each of the two inputs 5, 9. In a typical case, the output 13 drives the display device at a rate of one step, on each revolution that it performs. It will be noted that it is also possible to provide several correction steps per complete rotation of the output 13, as a function of the construction of the display device and of the plates 13*a*, 13*b*. For example, each third or quarter (or other division) of a revolution of the output could drive the display device by one correction step, depending on the case.

In order, following a correction, for the angular position of the output 13 to remain synchronized with respect to the first input 5, and for the driving of the display device to be performed at the right moment, that is to say at around midnight, the device 1 comprises means which make it possible to bring the output 13 substantially back to its initial angular orientation, prior to the correction, once the correction is finished.

To do this, the correction gear-train 11 comprises, on the one hand, a clutch 21 permitting to establish and to break the kinematic link between the correction stem 19 and the second input 9 according to the axial position of the stem 19 and, on the other hand, a memory cam 23.

The clutch 21 can be of any type, such as one with sliding pinion and pull-out piece, of toggle type, a horizontal clutch, a unidirectional ratchet or the like, for example as illustrated in the document CH 1016. In the embodiment illustrated, the clutch comprises a sliding pinion 25 actuated by a pull-out piece that is not illustrated. The axial position of the sliding pinion 25 determines whether the latter is rotationally-linked to the stem 19 or not. Other means for controlling the clutch 21 are accessible to the person skilled in the art.

The memory cam 23 is secured in rotation to a wheel 27 which is desmodromically linked with the second input 9. In the embodiment illustrated, the wheel 27 meshes with a wheel 29 forming part of the kinematic chain linking the clutch 25 to the second input 9. Alternatively, the memory cam 23 can be arranged secured in rotation to an element of this kinematic chain or be incorporated in the second input 9 of the differential gear 3. Also alternatively, the memory cam 23 can be linked with said second input 9 by means of its own dedicated gear-train.

The form of the memory cam 23 is chosen to optimize the torque available after correction. In most cases, a correction will be made in the direction of advance of the indications provided by the display device after the piece has been stopped for a certain time. Corrections in the other direction are rarer, and consequently the memory cam 23 can have an asymmetrical form arranged to provide more torque in one direction of rotation than in the other. However, it is perfectly possible to use a symmetrical cam or one which has another suitable form.

During normal operation of the piece, the clutch 21 is declutched and the memory cam 23 is positioned by a return force provided by a spring 31 whose position is controlled by the axial position of the stem 19. In this state, the spring 31 is positioned so as to exert sufficient force on the memory cam 23 for it to block the correction gear-train 11 against any stray torques originating from the rotation of the first input 5 and the output 13. Thus, the second input 9 is also blocked in a predetermined angular position so that the output 13 remains synchronized with the first input 5. In the embodiment illustrated, the spring 31 is mounted on the stem 19, but other constructions are accessible to the person skilled in the art. It is also possible for the spring 31 to be mounted on a frame element independently of the control member 19.

During a correction, the axial displacement of the stem 19 raises the spring 31 so that the latter exerts a lesser pressure on the memory cam 23, in order to facilitate a correction operation. The output 13 of the differential 3 is pivoted as a function of the rotations of the stem 19 and the display device that it controls can be corrected.

During the correction, the memory cam 23 is also driven in rotation. In the embodiment illustrated, the memory cam 23 is heart-shaped having a single lobe, and its gear ratio with the second input 9 is chosen such that the memory cam 23 pivots at a rate of one complete revolution per rotation of the output 13 under the control of the angular displacements of the second input 9. To this end, since the gear ratio between the second input 9 and the output 13 is 2/3 (which means that 1.5 revolutions of the second input 9 drives the output 13 by one revolution), that between the second input 9 and the memory cam 23 is 1.5. These ratios can be modified according to the needs of the constructor. Alternatively, the memory cam 23 can have several lobes and pivot by, for example, a third or a quarter of a revolution per complete rotation of the output 13, as a function of the number of lobes.

In general, the second input 9 will have several angular orientations for which its contribution to the angular position of the output 13 is nil, these positions being separated from one another by more than 360°. Such a unique angular orientation arises exclusively in the case of a gear ratio of 1:1 between the second input 9 and the output. For the general case, the person skilled in the art knows how to calculate, using the Willis formula, the gear ratios necessary in order to ensure that the positioning of the memory cam 23 by the return force cancels the effect of the second input 9 and thus restores the synchronization between the first input 5 and the output 13.

In light of the above, it is understood that the memory cam 23 "memorizes" the contribution to the angular position of the output 13 provided by the second input 9.

After the user has made a correction, he or she puts the stem 19 back into its initial axial position, which declutches the clutch 21. The spring 31 once again presses against the correction cam 23, which tends to drive the correction gear-train 11, which is now free to pivot. Since the first input 5 remains (quasi-)blocked by the kinematic chain which drives it, the return force exerted by the spring 31 on the memory cam 23 pivots the wheel 27 and the rest of the correction gear-train 11 until the cam 23 reverts to its initial angular position, as illustrated in FIG. 1. Thereby, the second input 9 is piloted such that its contribution to a possible fraction of a revolution of the output 13 is cancelled. The output 13 thus reverts to the angular position that it would have had in the absence of a correction, and its angular position is once again only defined by the first input 5. In other words, the output 13 performs only entire revolutions after the addition or the subtraction made under the control of the memory cam, notwithstanding a possible impact of the first input during the correction. In the context of a perpetual calendar, this causes the jump in the day of the month to be performed at around midnight even after a correction.

Figure 2:
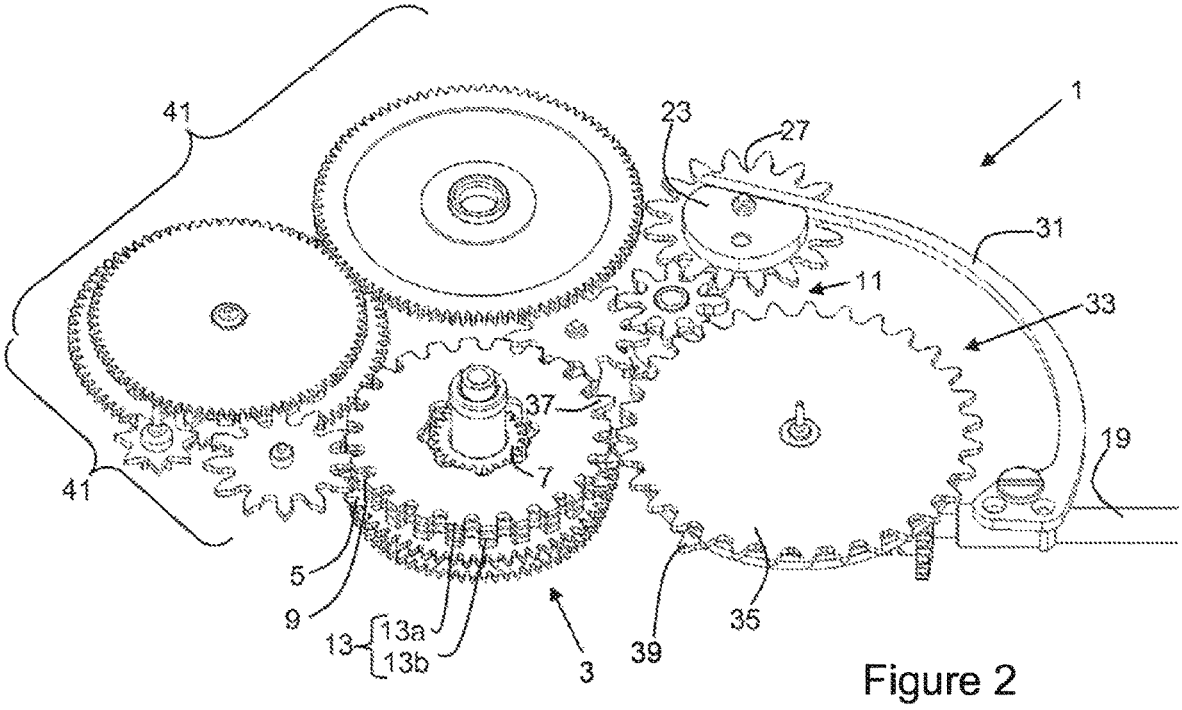
FIG. 2 is an isometric view of the correction device of FIG. 1, illustrated jointly with the wheels with which it interacts.
Figure 3:
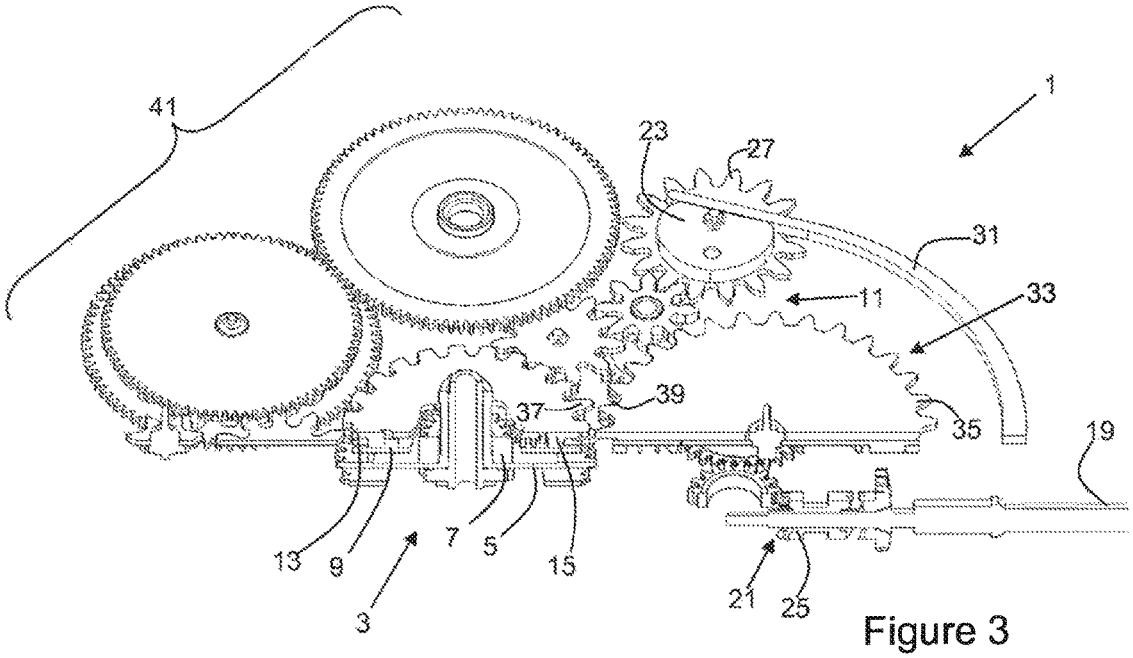
FIG. 3 is the view of FIG. 2 cut along a plane which intersects the axis of rotation of the differential gear and which extends from the correction stem.

FIGS. 2 and 3 illustrate the correction device 1 of the invention in combination with kinematically adjacent components of an annual calendar device, in order to better illustrate the significance of the functionality of said correction device 1.

The annual calendar device comprises a programme wheel 33 which comprises a date plate 35 having 31 teeth and a correction plate 39 coaxial to the date plate 35. The latter is arranged to be driven by one step per 24 hours by means of the actuation tooth 37 which extends from the toothed plate 13*a* of the output. The toothed plate 13*b* comprises several longer teeth which interact with a corresponding tooth of the correction plate 39 in order to advance the programme wheel by one additional step at the end of the months that have thirty days. In the case of a perpetual calendar device, it is possible to also provide one or more additional correction plates (not illustrated) that are secured in rotation to the date plate 35 and which interact also with the lower plate 13*b* or with an additional plate secured in rotation to the plates 13*a*, 13*b*, in order to automatically make a correction at the end of the month of February in a known manner. To this end, the various plates each have an appropriate number of teeth, in function of the number of days of the month. In the case of a simple date mechanism, the correction plate 39 and the plate 13*b* can be omitted.

On the left of the figures is situated a mechanism for displaying days of the week and the phases of the moon 41, which is driven by means of the lower plate 13*b* of the output 13, and which need not be described in more detail.

By virtue of the construction of the plates 13*a*, 13*b* of the output 13 and of the programme wheel 33, notably at the single long tooth 37 of the upper plate 13*a* of the output 13, it is understood that the output 13 must pivot by one complete revolution per correction step of the programme wheel 33. Moreover, if, after a correction, the output 13 is mal-adjusted relative to the programme wheel 33, its advance will take place at an inappropriate moment.

Consequently, in the absence of the memory cam 13, it is almost impossible for the user to be able to return the output 13 to the right angular orientation after correction, which the correction device 1 according to the invention does automatically as described above.

Although the invention has been particularly shown and described with reference to particular embodiments, other variants and constructions of the correction device 1 are possible without departing from the scope of the invention as defined in the claims.

In this respect, it can be mentioned that the correction device can directly or indirectly drive a display member, for example of a simple date, the construction of the output 13 being adapted accordingly. For example, the output could simply bear a single finger for directly or indirectly driving a date ring gear.

Moreover, with regard to the differential gear, it is not mandatory for its output 13 to directly bear a plate 13*a*, 13*b* or a similar element which interacts directly with a programme wheel 33, a date wheel or a display member. Indeed, the output 13 can be a toothed wheel which in turn drives an intermediate wheel which directly or indirectly drives such an element.

The invention claimed is:

1. Correction device for a timepiece, comprising a differential gear having a first input, a second input and an output, wherein:

the first input is arranged to be driven by a timepiece movement;

the second input is kinematically linked with a corrector gear-train extending from a control member and comprising a clutch permitting to establish and to break the kinematic link between said control member and said second input;

the output is arranged to drive a display device of said timepiece movement, the angular position of said output being defined as a function of the angular position of said first input and of that of said second input, wherein said correction device further comprises a memory cam desmodromically linked with said second input, wherein said memory cam is subjected to a return force supplied by an elastic member tending to keep said memory cam in at least one predetermined angular position when said kinematic link between said control member and said second input is broken, said elastic member being further arranged to allow a rotation of said second input under the control of said control member when said kinematic link is established upon the operation of the correction device, and wherein said correction device is arranged in such a way that the incidence of the rotation of the second input during a correction on the angular position of the output is cancelled when said memory cam is in said at least one predetermined angular position.

2. Correction device according to claim 1, wherein said correction gear-train comprises a clutch situated kinematically between said memory cam and said control member.

3. Correction device according to claim 1, wherein said memory cam is secured in rotation to a wheel which forms part of said correction gear-train or which meshes with a single other wheel of said correction gear-train.

4. Correction device according to claim 1, wherein said elastic member is arranged so as to be displaced under the control of the translational displacements of the control member.

5. Correction device according to claim 1, wherein:

said first input is secured in rotation to a sun pinion;

said second input is a satellite-holder provided with at least one satellite pinion engaged with said sun pinion; and said output comprises a toothed ring gear whose inner teeth mesh with said sun pinion.

6. Correction device according to claim 5, wherein said output is arranged to perform one rotation every 24 hours in normal operating mode.

7. Correction device according to claim 5, wherein said first input is arranged to perform one rotation every 12 hours in normal operating mode.

8. Correction device according to claim 5, wherein said output comprises at least one plate provided with at least one drive tooth.

9. Correction device according to claim 5, wherein said output comprises a plurality of toothed plates arranged to cooperate with a programme wheel comprised by a perpetual calendar device.

10. Timepiece movement provided with a correction device according to claim 1.

11. Timepiece comprising a movement according to claim 10.

* * * * *